US005533886A

United States Patent [19]

Von Der Heyde et al.

[11] Patent Number: 5,533,886

[45] Date of Patent: Jul. 9, 1996

[54] MEMBRANE PUMP AND METHOD OF OPERATING THE SAME

[75] Inventors: Richard Von Der Heyde, Vogtsburg; Erich Becker, Bad Krozingen; Heinz Riedlinger, Freiburg, all of Germany

[73] Assignee: KNF Neuberger GmbH, Freiburg-Munzingen, Germany

[21] Appl. No.: 171,647

[22] Filed: Dec. 22, 1993

[30] Foreign Application Priority Data

Dec. 31, 1992 [DE] Germany ..... 42 44 619.8

[51] Int. Cl.[6] ..... F04B 43/12; F04C 5/00

[52] U.S. Cl. ..... 418/1; 418/45; 418/50; 417/413.1

[58] Field of Search ..... 418/45, 50, 155, 418/1; 417/413.1

[56] References Cited

U.S. PATENT DOCUMENTS

| | | | |
|---|---|---|---|
| 2,722,893 | 11/1955 | Maillot | 103/148 |
| 3,058,428 | 10/1962 | Gemeinhardt | 418/50 |
| 3,922,119 | 11/1975 | Rosenquist | 418/45 |

FOREIGN PATENT DOCUMENTS

| | | | |
|---|---|---|---|
| 862840 | 3/1941 | France | 418/50 |
| 882958 | 11/1952 | Germany . | |
| 1184447 | 12/1964 | Germany . | |
| 1528971 | 7/1969 | Germany . | |
| 1945805 | 3/1971 | Germany . | |
| 2911609 | 9/1980 | Germany . | |
| 261912 | 1/1970 | U.S.S.R. | 417/413.1 |
| 1262108 | 10/1986 | U.S.S.R. | 418/50 |

*Primary Examiner*—Louis J. Casaregola
*Assistant Examiner*—William Wicker
*Attorney, Agent, or Firm*—Darby & Darby

[57] ABSTRACT

A membrane pump has a housing which includes a pump head provided with an internal recess. The pump head is further provided with an inlet opening and an outlet opening which communicate with the recess and are disposed next to one another near an edge of the housing. A membrane extends across the recess and is clamped at its edges by the housing. The membrane and recess together define a pumping chamber. A segment of the membrane is held stationary against the pump head by a clamping finger and forms a seal with the pump head. The seal extends radially between the inlet and outlet openings from the periphery of the pumping chamber to its center. A drive successively urges circumferentially successive segments of the unconfined part of the membrane into sealing engagement with the pump head to thus direct fluid from the inlet opening to the outlet opening.

47 Claims, 11 Drawing Sheets

MEMBRANE PUMP AND METHOD OF OPERATING THE SAME

FIELD OF THE INVENTION

The invention relates to a membrane pump and a method of operating such a pump.

BACKGROUND OF THE INVENTION

A type of membrane pump known for a long time has a pump head provided with a recess. See, for example, the German Offenlegungsschrift 1 184 447. The pumping chamber is located in the recess and, on the side of the pump drive, is closed by a flat membrane, e.g., a disc-like membrane. The pumping action is achieved by moving the membrane via a rod. The rod has a free end, and sections of the membrane are alternately gripped and stretched by the free end of the rod and an associated fastening disc. The other end of the rod is mounted eccentrically on a crankshaft so that, during operation of the pump, a lifting movement occurs approximately perpendicular to the plane of the flat membrane.

Such a membrane pump has the advantage, among others, that no lubricant and lubricant vapors enter the pumping chamber. On the other hand, a drawback of this membrane pump, among others, is its relatively noisy operation due to the back-and-forth motion of the rod and membrane.

Also known is a membrane pump having an annular pumping chamber which is bounded radially by a solid outer wall and an inner wall constituted by a deformable, annular membrane. See, for instance, the German patent 2 911 609. The annular membrane is moved by a circumferentially travelling drum. In this type of membrane pump, the inlet and outlet may be located next to one another and the pumping chamber divided by a clamped section of the membrane disposed between the inlet and the outlet.

The annular membrane and associated pump are expensive to manufacture and still require a crank drive. The travelling drum prevents simple design and manufacture of the membrane which constitutes a wear component of the pump. Moreover, replacement of the annular membrane is relatively difficult. In addition, the annular membrane requires a relatively large amount of space.

SUMMARY OF THE INVENTION

It is an object of the invention to provide a membrane pump capable of operating relatively quietly.

Another object of the invention is to provide a membrane pump which can be manufactured relatively inexpensively.

An additional object of the invention is to provide a membrane pump which allows membrane replacement to be carried out relatively easily.

A further object of the invention is to provide a membrane pump which can be constructed relatively compactly.

It is also an object of the invention to provide an operating method which enables relatively quiet operation of a membrane pump to be achieved.

Still another object of the invention is to provide an operating method which permits the manufacturing cost of a membrane pump to be reduced.

One more object of the invention is to provide an operating method which makes it possible to simplify membrane replacement.

An additional object of the invention is to provide an operating method which can be carried out in a relatively small space.

The preceding objects, as well as others which will become apparent as the description proceeds, are achieved by the invention.

One aspect of the invention resides in a method of operating a pump having a pumping chamber bounded in part by a membranous wall or membrane. The method comprises the steps of admitting a flowable medium into the pumping chamber at a first location; discharging the flowable medium from the pumping chamber at a second location; maintaining a seal between the first and second locations, and partway across the pumping chamber, by holding a first or sealing segment of the membrane substantially stationary and using the sealing segment as part of the seal; and directing the flowable medium from the first location to the second location by successively displacing successive second segments of the membrane, as considered in a direction from the first location towards the second location.

The directing step may involve the successive displacement of circumferentially adjoining segments of the membrane and may be performed cyclically.

The seal can extend from the periphery of the pumping chamber at least to the region of its center. The arrangement is preferably such that the seal extends radially of the pumping chamber and the membranous wall.

The method of the invention not only makes it possible to operate with a substantially flat membrane but allows a pumping action to be achieved with a revolving displacement volume and essentially no lifting movements. The membrane may be produced and replaced relatively easily. The pump operates relatively quietly, and the vibrations arising in comparable membrane pumps due to lifting movements are largely eliminated.

Another aspect of the invention resides in a pump which comprises a housing having wall means defining a pumping chamber. The wall means includes a membranous first wall or membrane, and a second wall which is disposed opposite the membrane and is provided with an inlet and an outlet. The pump further comprises means for maintaining a first or sealing segment of the membrane adjacent the second wall between the inlet and the outlet so as to establish a seal which extends between the inlet and the outlet partway across the pumping chamber. The pump additionally comprises means for successively urging successive second segments of the membrane, as considered in a direction from the inlet towards the outlet, towards the second wall to thereby direct a flowable medium from the inlet to the outlet.

The membrane may have a marginal portion which is in sealing engagement with the housing. The seal established with the sealing segment of the membrane may extend from the periphery of the pumping chamber at least to the vicinity of its center. It is preferred for the arrangement to be such that the seal extends in radial direction of the pumping chamber and the membrane.

The urging means can be designed to successively displace circumferentially adjoining segments of the membrane. The displacements may be carried out cyclically.

The pump in accordance with the invention can be used to perform the method of the invention. Various embodiments of the pump are provided.

In one embodiment, the urging means includes a rod-like element which is connected to the membrane. The membrane has a central axis and the rod-like element has an end which is laterally spaced from the central axis. The pump here further comprises a driving element for moving this end of the rod-like element along a closed path, e.g., a generally circular path, having a center which lies at least in the region of the central axis of the membrane.

This embodiment of the pump makes it possible, using relatively simple drive means, for the central working portion of an approximately flat membrane to undergo a pumping motion by revolution of a drive element around a pumping chamber. Due to the special design of the drive for the membrane, the working portion of the membrane performs a sort of cyclic movement in circumferential direction of the pumping chamber.

The rod-like element may be mounted on a protuberance of the membrane. The protuberance can have a relatively great radial thickness, and the rod-like element preferably has a radially protruding coupling portion which is engaged by a complementary coupling portion of the protuberance. The rod-like element can be vulcanized to the protuberance. By making the protuberance relatively thick radially, good force transmission can be obtained. Moreover, the provision of a radially protruding portion on the rod-like element permits good guidance of the membrane, as well as a stable connection between the rod-like and the membrane, to be achieved.

The urging means in another embodiment of the pump includes a pressure roller movable along a closed path having a center which lies at least in the region of the central axis of the membrane.

The latter embodiment of the pump can be manufactured with relatively simple means. It is particularly well-suited for low rpm since, at low rpm, the pressure roller can be more readily deflected in the region of the stationary sealing segment of the membrane.

In a further embodiment of the pump, the urging means includes one or more magnets on the membrane, and means for subjecting the magnet or magnets to a rotating magnetic field. If the membrane is provided with a plurality of magnets, these may be distributed circumferentially of the membrane.

This embodiment of the pump is especially simple as regards the drive system for the membrane. A mechanical drive can be completely eliminated, or at least greatly simplified, and the membrane movement required for pumping generated by a rotating magnetic field.

At least a portion of the pumping chamber can be constituted by a recess provided in the pump housing, preferably the pump head or cover, opposite the membrane. This allows an increase in the pump volume to be obtained in an advantageous manner.

The pump head may be in the form of a substantially flat disc which, on the side facing the membrane, has the recess constituting part of the pumping chamber. This side of the pump head may further be provided with a separating rib which extends radially from the periphery of the pumping chamber to at least the region of its center. The separating rib, which favorably lies approximately midway between the inlet and outlet of the pumping chamber, serves as an abutment for the sealing segment of the membrane. This enables the desired sealing effect between the inlet and the outlet to be achieved with a membrane of simple shape.

A clamping element may be provided in order to maintain the sealing segment of the membrane adjacent the opposite wall of the pumping chamber. The clamping element is located on that side of the membrane which faces away from the pumping chamber and serves to press the other side of the membrane against such wall. The pump preferably comprises means for adjusting the clamping force exerted by the clamping element.

The clamping element permits the sealing action of the sealing segment to be mechanically adjusted and eliminates the need for securing the sealing segment to the opposite wall of the housing, e.g., adhesively. The clamping element also simplifies assembly of the pump as well as replacement of a membrane.

The clamping element can be in the form of a clamping finger which advantageously extends radially of the membrane towards the central axis thereof. The clamping finger may be eccentrically mounted on the pump housing, and it is preferred for the clamping finger to be adjustable from externally of the housing. This arrangement makes it possible to readily vary the sealing action of the sealing segment by rotating the clamping finger on its axis.

The pumping chamber may be essentially rotationally symmetrical about the central axis of the pump. This facilitates production of the recess constituting part of the pumping chamber. The sealing segment can be provided with a sealing ridge which protrudes into the pumping chamber and is matched to the cross-sectional configuration thereof. The clamping finger then urges the sealing ridge against the opposite wall of the pumping chamber.

The recess constituting part of the pumping chamber can have a shape approximating that of a spherical dome. In this manner, the size of the pumping chamber, and hence the capacity of the pump, can be increased while nevertheless allowing the pump head to be manufactured simply.

A support can be mounted in the working area of the membrane on the side of the latter facing away from the pumping chamber. In the embodiment of the pump having a rod-like element as part of the urging means, this support is advantageously secured to the rod-like element. The support can have a basin-like or pot-like cross section and may include a supporting rim which is formed by a bend in the support. The supporting rim, which engages and is substantially parallel to the membrane, is provided with a cutout in the region of the sealing segment of the membrane. The cutout is sufficiently large to receive the clamping finger and is preferably so large that the supporting rim remains clear of the clamping finger as the supporting rim moves with the membrane. By providing support for the membrane, undesired deflections of the membrane can be avoided.

The membrane can be formed with a raised bead on the side facing away from the pumping chamber. The raised bead makes it possible to establish a better seal between the membrane and the opposite wall of the pumping chamber in the central region of the chamber. The active volume of the pump is then more precisely restricted to the central region to thereby counteract fluctuations in capacity.

BRIEF DESCRIPTION OF THE DRAWINGS

Other features and advantages of the invention will become apparent from the following description of preferred embodiments when read in conjunction with the accompanying drawings.

DESCRIPTION OF PREFERRED EMBODIMENTS

Figure 1:
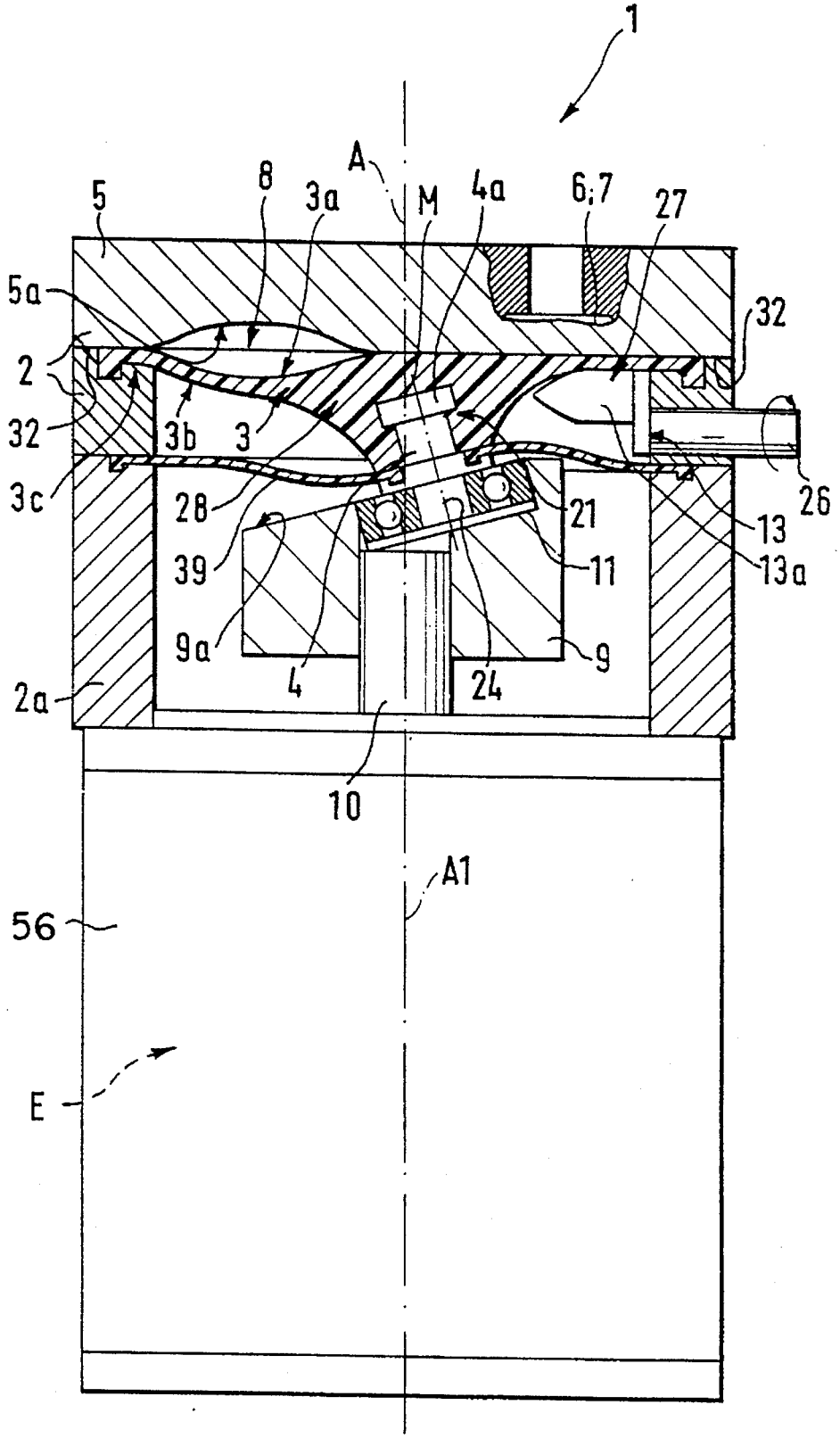
FIG. 1 is a partly sectional longitudinal view of one embodiment of a membrane pump in accordance with the invention showing one embodiment of a membrane and one embodiment of a pump head.

In FIG. 1, the reference numeral 1 generally identifies a membrane pump in accordance with the invention. The pump 1 includes a pump housing 2 having a circular membrane or membranous wall 3 which is connected with a drive pin or rod-like drive element 4. The pump housing 2 comprises a pump head or cover 5 which closes the pump housing 2 from above. The pump head 5 is provided with an inlet opening 6 and an outlet opening 7 which are located at a small distance from one another in the circumferential direction of the pump 1.

The membrane 3 has an outer margin or marginal portion 3*c* which is confined by, and forms a seal with, an outer rim or margin 32 of the pump head 5. The upper side 3*a* of the membrane 3 faces the pump head 5 while the lower side 3*b* of the membrane 3 faces the part of the pump 1 containing the drive system for the membrane 3.

The membrane 3 and pump head 5 cooperate to define a pumping chamber 8, and the membrane 3 may be considered to constitute a first wall of the pumping chamber 8 whereas the pump head 5 may be considered to constitute a second wall of the pumping chamber 8. The membrane 3 has a stationary sealing segment 27 which is located between the inlet opening 6 and the outlet opening 7 and forms a seal with the pump head 5. The sealing segment 27 and the corresponding seal extend radially from the confined margin 3*c* of the membrane 3, i.e., from the periphery of the pumping chamber 8, to the midpoint M of the membrane 3 and the pumping chamber 8.

On the side 3*b* facing away from the pump head 5, the central region of the membrane 3 is provided with a thickened, bead-shaped or funnel-shaped fastening protuberance 21. The drive pin 4 extends into the fastening protuberance 21 and is connected therewith. For instance, the drive pin 4 and fastening protuberance 21 can be provided with complementary coupling portions serving to lock the drive pin 4 to the fastening protuberance 21. Thus, the end of the drive pin 4 facing the membrane 3 can be provided with a widened or radially protruding connecting head 4*a* which, by way of example, can be plate-shaped. Alternatively or additionally, the drive pin 4 can be vulcanized to the fastening protuberance 21.

The end of the drive pin 4 facing away from the membrane 3 is coupled to a drive shaft 10 of an electric motor E by means of a bearing retainer 9 and a roller bearing 11. The electric motor E is housed in a motor casing 56. The drive shaft 10 extends along the central axis A of the membrane 3, and the longitudinal axis A1 of the drive shaft 10 coincides with the central axis A. The roller bearing 11 and bearing retainer 9 are fast, and can rotate, with the drive shaft 10. The drive pin 4 is mounted in the roller bearing 11, preferably so that the roller bearing 11 can rotate relative to the drive pin 4.

The bearing retainer 9 has a supporting surface 9*a* which faces the membrane 3 and is inclined to the central axis A of the membrane 3. The drive pin 4 is perpendicular to the inclined supporting surface 9*a* and is eccentric with respect to the central axis A and the drive shaft 10.

The longitudinal axis 24 of the drive pin 4 is inclined to, and the connecting head 4*a* of the drive pin 4 faces, the central axis A. Due to the inclination of the drive pin 4 relative to the axes A, A1, the connecting head 4*a* has a pair of diametrically opposed edge sections which are spaced from the underside of the pump head 5 by different distances. During pump operation, i.e., when the drive shaft 10 rotates, the drive pin 4 executes a sort of cyclic wobbling motion about the central axis A. The central region 28 of the membrane 3 is pressed into sealing engagement with the underside of the pump head 5 by the uppermost edge section of the connecting head 4*a*. On the other hand, as the drive pin 4 rotates, the region of the membrane 3 adjacent the lowermost edge section of the connecting head 4*a* is displaced with the displacement taking place cyclically for successive segments of the membrane 3, as considered circumferentially of the axes A, A1. Thus, the membrane 3 and its thickened central fastening protuberance 21 are cyclically deflected relative to the pump head 5 with accompanying elastic deformation of the membrane 3. Deflection takes place successively for successive segments of the membrane 3, as considered in circumferential direction of the pumping chamber 8, and occurs eccentrically to the axes A, A1.

The sealing segment 27 of the membrane 3 disposed between the inlet and outlet openings 6, 7 is pressed into sealing engagement with the adjoining region of the pump head 5 by a clamping finger 13*a* which bears against the lower side 3*b* of the membrane 3. The clamping finger 13*a* extends radially towards the midpoint M of the membrane 3. An adjusting arm 13 for the clamping finger 13*a* is mounted on the peripheral wall 2*a* of the pump housing 2 and can be manipulated from externally of the pump housing 2 by way of an adjusting shaft 26 which projects from the housing 2. The adjusting arm 13 is situated eccentrically with respect to the longitudinal axis of the clamping finger 13*a*. By rotating the adjusting shaft 26, the clamping force which the clamping finger 13*a* exerts on the sealing segment 27 of the membrane 3 can be adjusted.

The clamping action of the clamping finger 13*a* extends radially from the periphery of the pumping chamber 8, i.e., from the confined margin 3*c* of the membrane 3, to approximately the midpoint M of the membrane 3. The sealing segment 27 of the membrane 3 is there held in sealing engagement with the pump head 5 to form a sealing zone or seal. The sealing segment 27 accordingly does not participate in the bubble-like, cyclical deflection of successive segments of the membrane 3, as considered circumferentially of the pumping chamber 8, away from the pump head 5. Hence, with respect to the pumping chamber 8, the sealing segment 27 of the membrane 3 defines a sort of dead point of the membrane pump 1.

Figure 3:
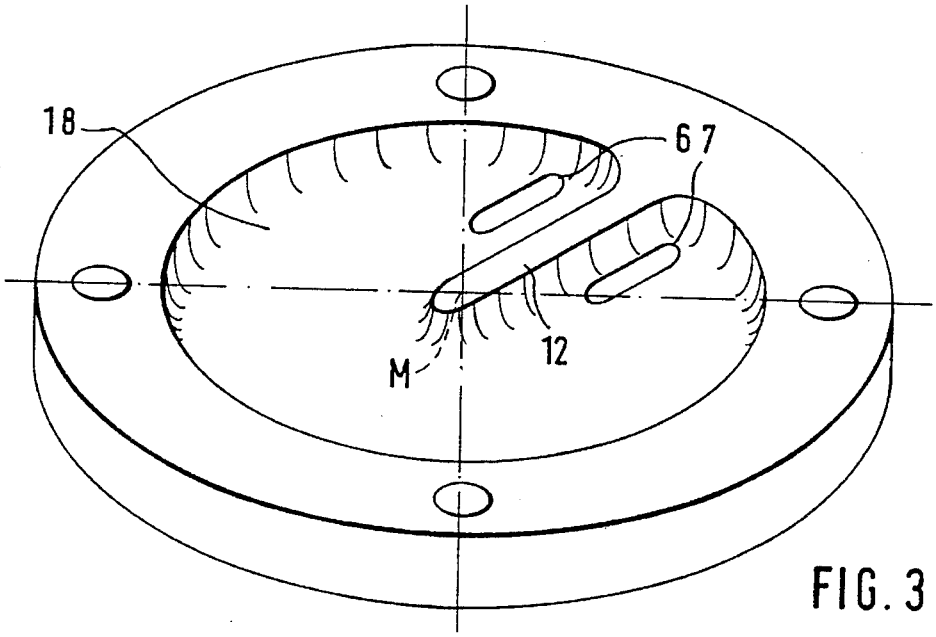
FIG. 3 is a perspective view of the pump head of FIG. 1.

As illustrated in FIG. 3, the side of the pump head 5 facing the membrane 3 has a recess 18 in order to increase the pump volume. A separating rib 12 is disposed in the recess 18 and extends radially from the periphery of the recess 18 to approximately the center of the pump head 5. The separating rib 5 serves as an abutment for the sealing segment 27 of the membrane 3.

Figure 4:
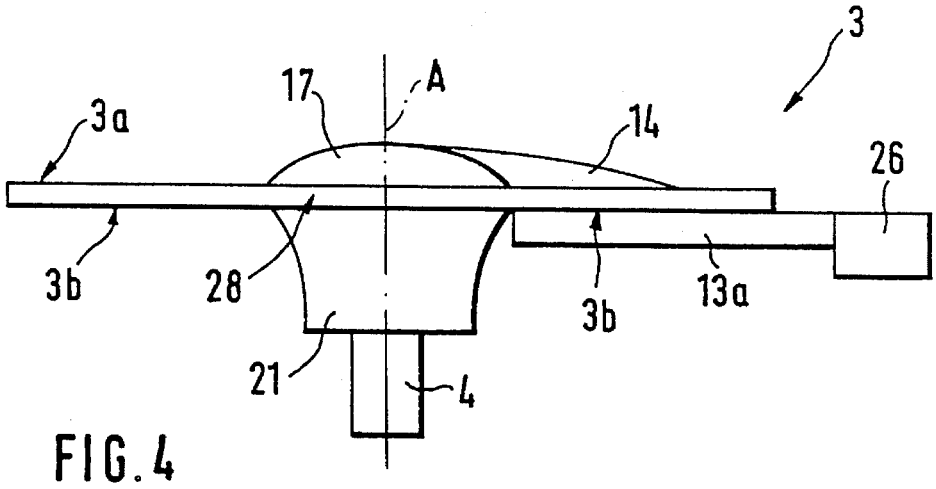
FIG. 4 is a side view of another embodiment of a membrane showing a drive element and a clamping element for the membrane.
Figure 5:
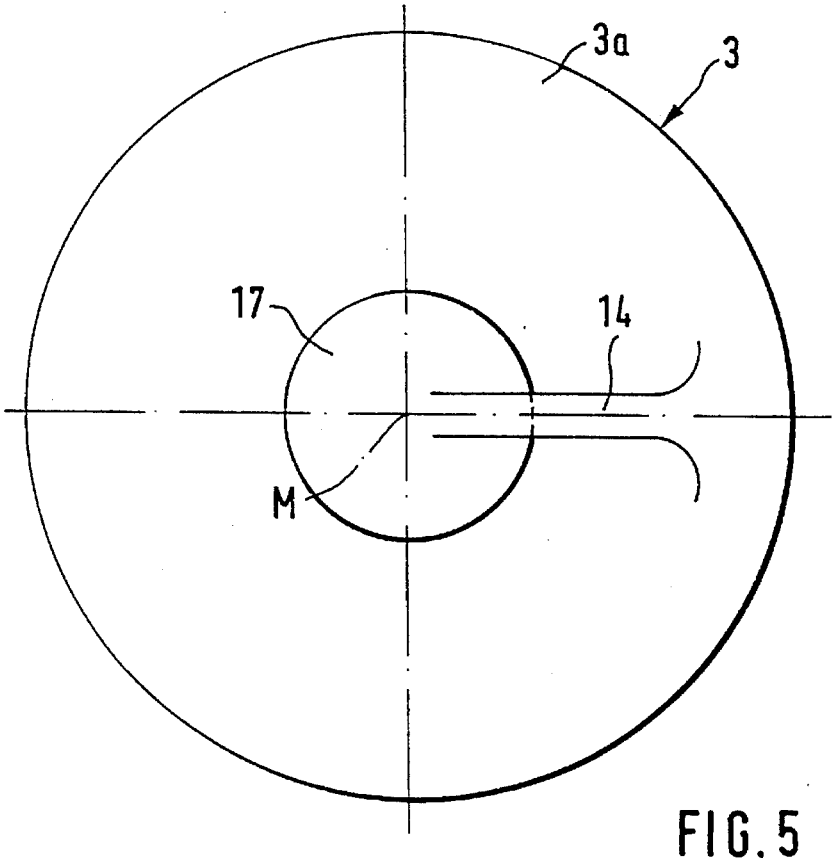
FIG. 5 is a plan view of the membrane of FIG. 4.

FIGS. 4 and 5 show that the side 3*a* of the central region 28 of the membrane 3 facing the pump head 5 can be provided with a raised bead 17. The rotating drive pin 4 presses the raised bead 17 against the adjoining central region of the underside of the pump head 5 thereby enhancing the sealing effect at this location.

Instead of the separating rib 12 on the pump head 5, the side 3*a* of the membrane 3 facing the pumping chamber 8 can be provided with a rib-like sealing ridge 14 as also illustrated in FIGS. 4 and 5. The sealing ridge 14, which is situated on the sealing segment 27 of the membrane 3, preferably extends radially from the central sealing bead 17 to the confined margin 3*c* of the membrane 3. The sealing ridge 14 is pressed against the adjacent surface portion of the pump head 5 by the clamping finger 13*a* located at the underside 3*b* of the membrane 3 so that a better seal is obtained in this area.

Figure 6:
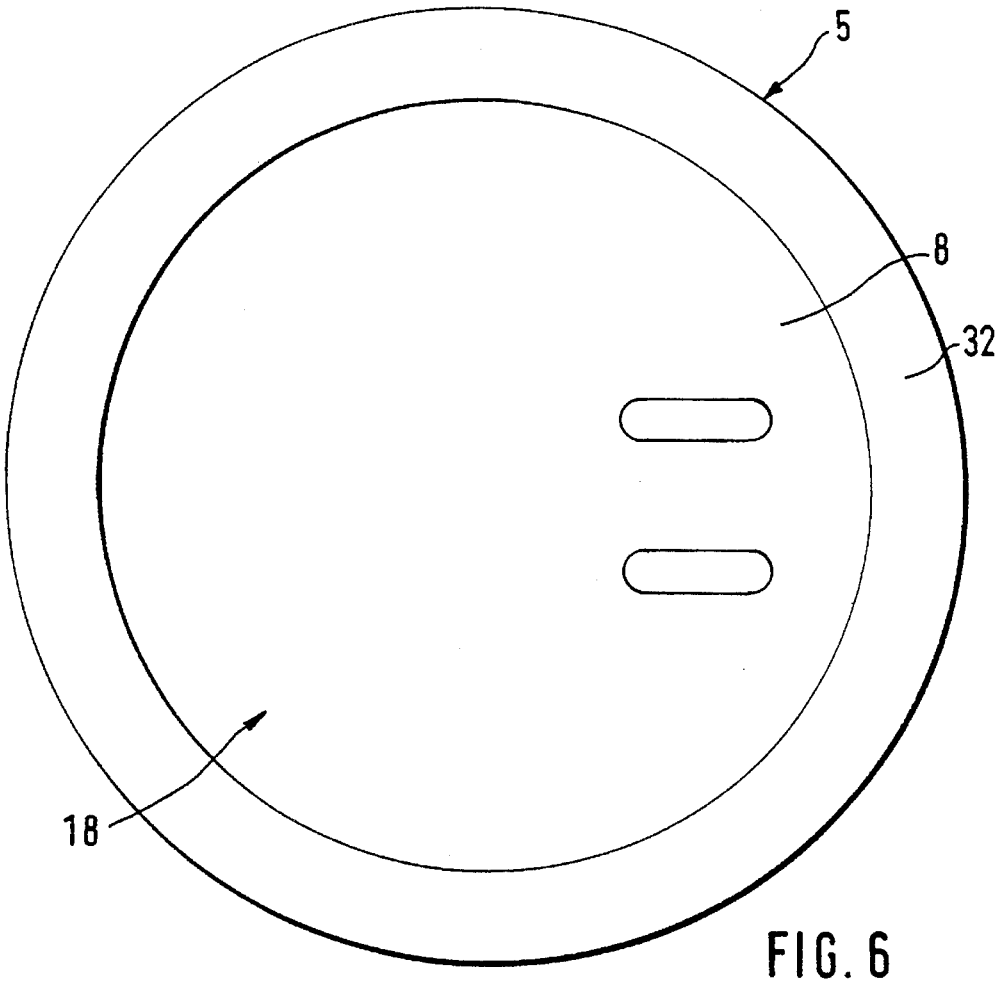
FIG. 6 is a bottom view of another embodiment of a pump head.
Figure 7:
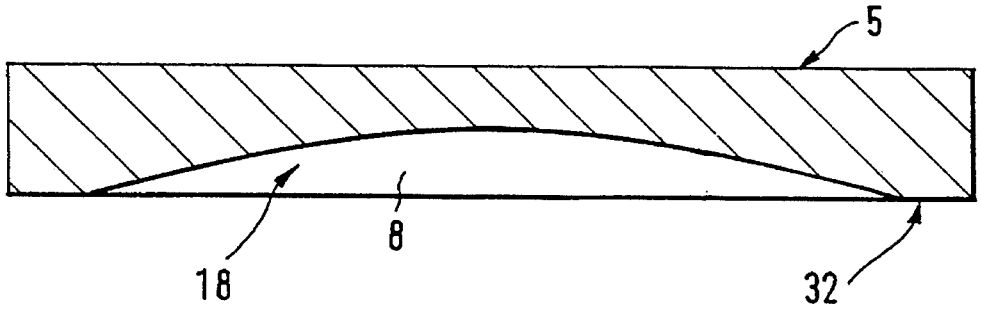
FIG. 7 is a cross-sectional view of the pump head of FIG. 6.

FIGS. 6 and 7 show a recess 18 for the pump head 5 which is particularly well-adapted for use with the membrane 3 of FIGS. 4 and 5. The recess 18 is part-spherical or dome-shaped and again serves to increase the size of the pumping chamber 8, and thus the pump capacity. The pump chamber 8 of FIGS. 6 and 7 has a very simple shape and can be easily manufactured.

Figure 8:
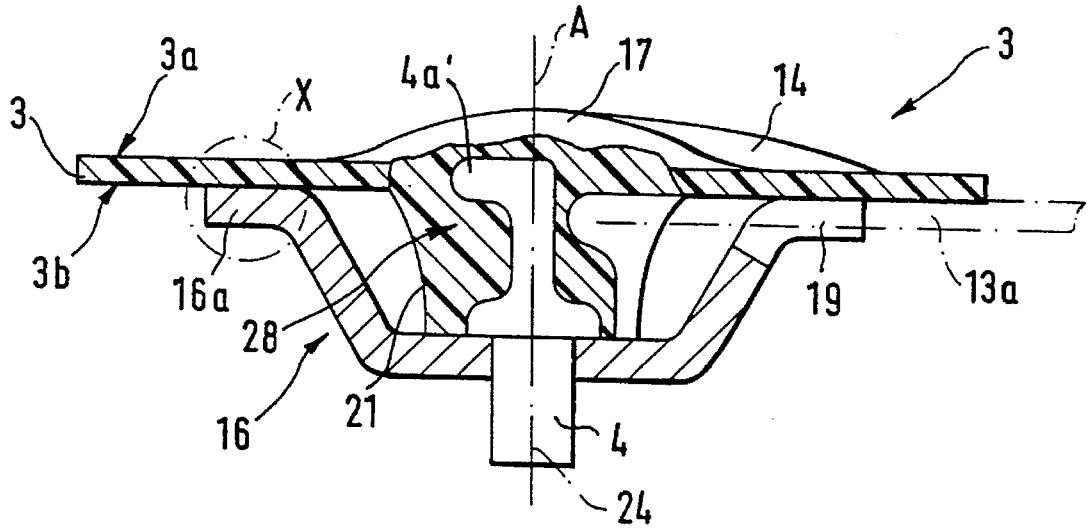
FIG. 8 is a partly sectional view illustrating the membrane, drive element and clamping element of FIG. 4 together with a support for the membrane.
Figure 22:
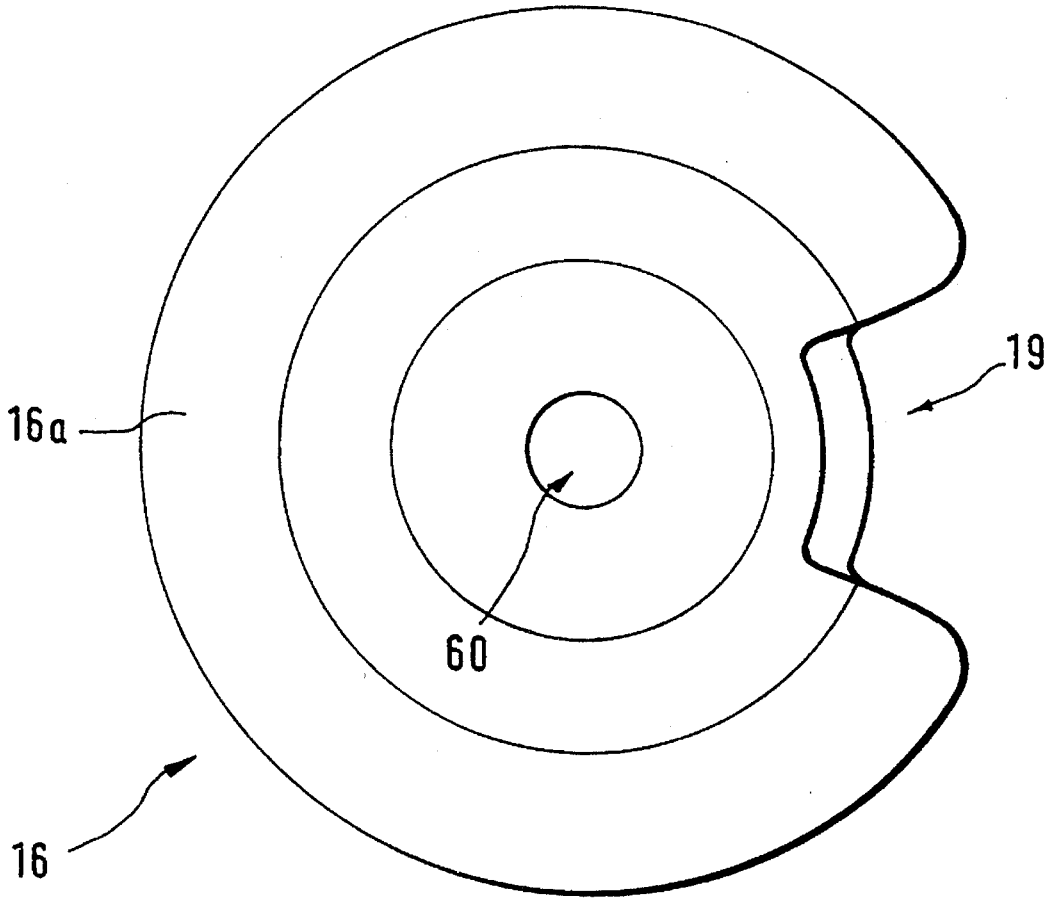
FIG. 22 is a plan view of the support of FIG. 8.

Referring to FIGS. 8 and 22, the side 3*b* of the membrane 3 facing away from the pumping chamber 8 may be provided with a support 16. The support 16 is pot-shaped or basin-shaped in cross section, and the bottom of the support 16 is secured to the drive pin 4 in the vicinity of the central fastening protuberance 21 of the membrane 3. To this end, the bottom of the support 16 is provided with a central opening 60 which receives the drive pin 4. The support 16 has a supporting rim 16*a* which is bent so as to be parallel to the underside 3*b* of the membrane 3, at least in the undeformed condition of the latter, and engages the underside 3*b*. The support 16 serves to prevent excessive bending of the membrane 3. A cutout 19 is formed in the support 16 in the region of the clamping finger 13*a* and prevents excessive compression in such region. When the membrane 3 is provided with a sealing ridge 14, the cutout 19 further prevents undue pressure from being exerted in the area of the ridge 14 upon tilting of the support 16. The cutout 19 receives the clamping finger 13*a* with a clearance which is sufficiently large that the clamping finger 13*a* and support 16 do not contact one another during deflection of the membrane 3.

Figure 11:
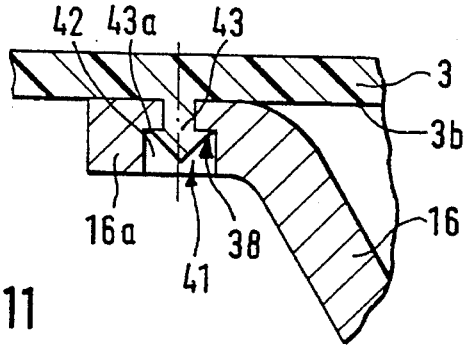
FIG. 11 is an enlarged view of the circled area X of FIG. 8.

FIG. 11 shows that the membrane 3 and support 16 are coupled to one another by joints 41. The joints 41 are constituted by undercut locking openings 42 in the supporting rim 16*a* of the support 16 and arrow-shaped locking pins 43 on the underside 3*b* of the membrane 3. The locking pins 43 are receivable in the locking openings 42. The locking pins 43 have shoulders 43*a* which bear against cooperating internal shoulders of the locking openings 42 to arrest the locking pins 43 in the locking openings 42. Since the membrane 3 is elastic, the locking pins 43 can be pushed into the locking openings 42 like pushbuttons.

Although the locking openings 42 of FIG. 11 are circular, this need not be the case. For instance, the round locking openings 42 can be replaced by locking openings which are segmented in circumferential direction thereof. Analogously shaped locking segments will then be substituted for the locking pins 43.

The support 16 prevents the membrane 3 from undergoing excessive deflection in a direction away from the pump head 5 and thus becoming overloaded. The joints 41 cause the membrane 3 to be displaced from the pump head 5 in correspondence to the basin-shaped support 16 when, for example, the membrane pump is used to create a vacuum or to generate suction. Since the support 16 receives its motion from the drive pin 4 for the membrane 3, the active region of the membrane 3 undergoes a predetermined cyclic movement, particularly where the membrane 3 "opens", i.e., enlarges, the pumping chamber 8.

Figure 9:
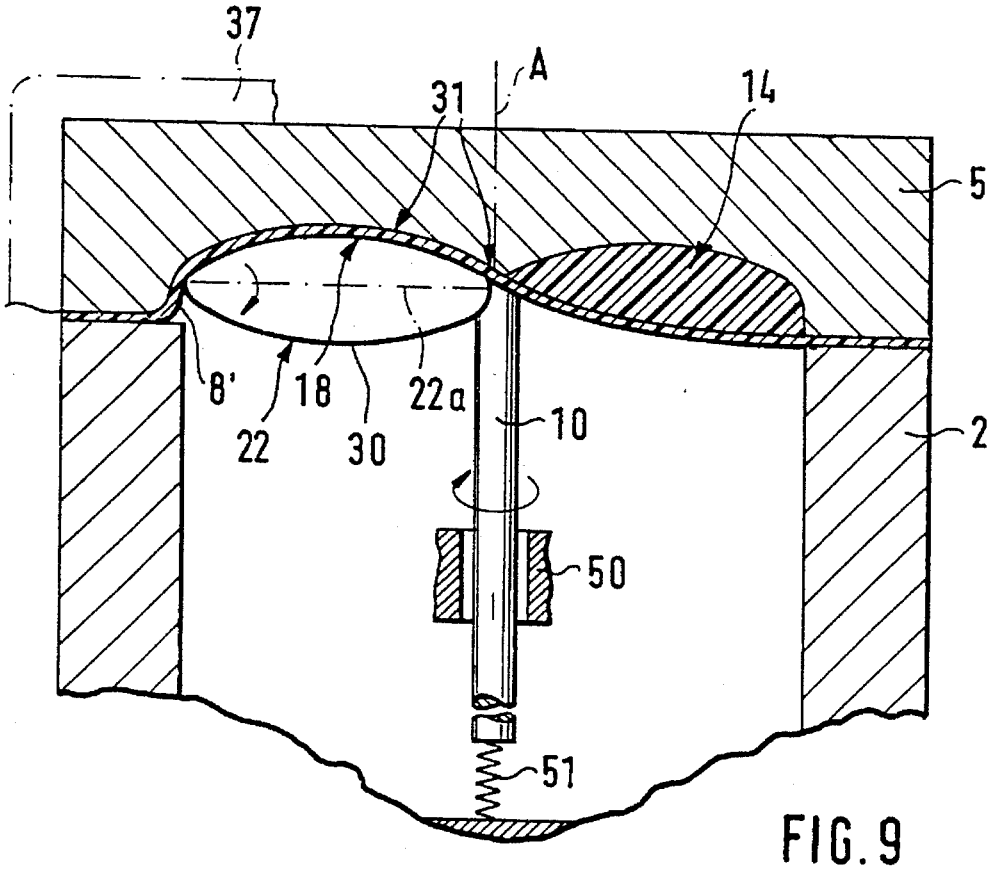
FIG. 9 is a fragmentary sectional view of an additional embodiment of a membrane pump according to the invention.

In FIG. 9, the drive pin 4 is replaced by a revolving pressure roller 22 which is eccentrically connected to the central drive shaft 10. The pressure roller 22 is mounted for rotation on an axis 22*a* which, as a rule, is radially oriented and perpendicular to the longitudinal axis of the drive shaft 10. It is preferred for the pressure roller 22 to have the outline of an ellipsoid. The peripheral surface 30 of the pressure roller 22 presses the membrane into the pumping chamber 8' and against the pump head 5. When the drive shaft 10 rotates, the pressure roller 22 travels eccentrically about a point on the central axis A of the membrane and cyclically presses successive segments of the membrane, as considered in circumferential direction of the pumping chamber 8', against the pump head 5. The side of the pump head 5 facing the pumping chamber 8' has a recess 18 which is matched to the shape of the pressure roller 22.

Figure 10:
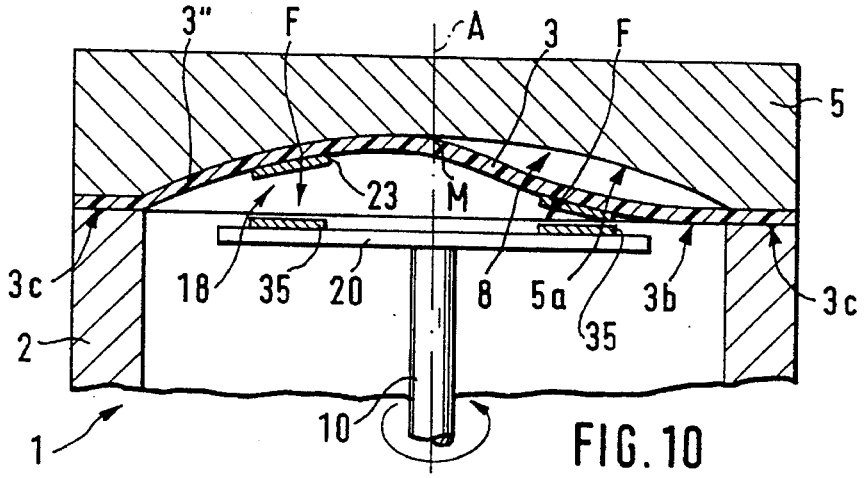
FIG. 10 is a fragmentary sectional view of a further embodiment of a membrane pump in accordance with the invention showing one embodiment of a carrier for magnets constituting part of a membrane drive system.

The sealing segment of the membrane of FIG. 9 can again be provided with a sealing ridge 14. In order that the pressure roller 22 can shift away from the pump head 5 in the region of the sealing segment, the drive shaft 10 is mounted in an axial bearing 50 which permits the drive shaft 10 to move axially, e.g., against the action of a spring 51.

with reference to FIG. 10, at least portions of the membrane 3 may be made magnetic so that one or more magnetic fields F which cyclically rotate about the central axis A of the membrane 3 can press successive segments 3" of the membrane 3 against corresponding segments of the inner surface 5*a* of the pump head 5. Thus, the side 3*b* of the membrane 3 which faces away from the pumping chamber 8 can be magnetic or can be provided with a set of individual magnets or magnetic layers 23 which are spaced from one another in circumferential direction of the pumping chamber 8. Such individual magnets 23 are flexible like the membrane 3 and are preferably symmetrically distributed about the central axis A of the membrane 3. Instead of placing the magnets 23 on the underside 3*b* of the membrane 3, the magnets 23 could be embedded in the underside 3*b*.

The cyclically rotating magnetic fields F can be produced by mounting magnets 35 on the drive shaft 10 eccentrically thereto. The magnets 35, which can be strip-shaped, are spaced from each other circumferentially of the pumping chamber 8. Depending upon whether a magnet 35 attracts or repels a magnet 23, a respective segment 3" of the membrane 3 is either pulled away from or pressed against the inner surface 5*a* of the pump head 5. The polarities of the magnets 23 and 35 are selected in such a manner that they cyclically urge segments 3" of the membrane 3 towards and away from the inner surface 5*a* of the pump head 5 so that the membrane 3 performs a rotary, cyclical pumping motion as the drive shaft 10 rotates. In other words, successive segments 3" of the membrane 3, as considered in circumferential direction of the pumping chamber 8, are successively displaced during rotation of the drive shaft 10.

The magnets 23 and 35 can be constituted by permanent magnets or electromagnets.

Figure 17:
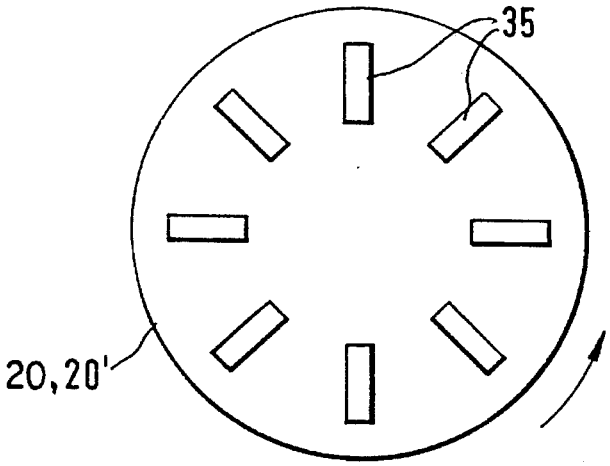
FIG. 17 is a plan view of the carrier of FIG. 16.

FIGS. 10 and 17 illustrate that the magnets 35 can be mounted on the drive shaft 10 by way of a magnet carrier 20 in the form of a flat disk. The carrier 20, which is located below the membrane 3, is fast with the drive shaft 10, and the magnets 35 are disposed on top of the carrier 20.

Figure 16:
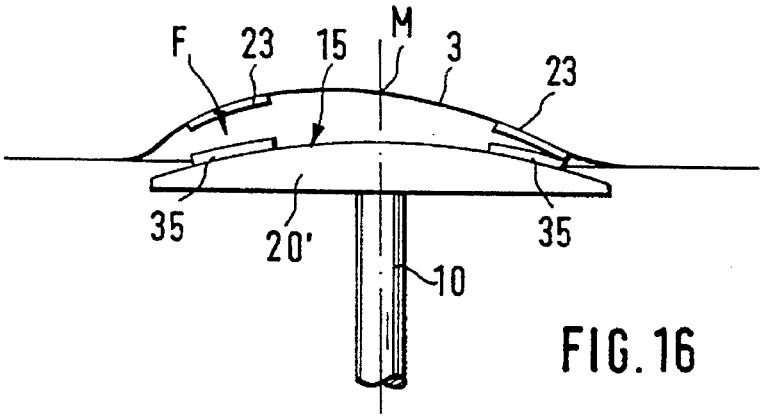
FIG. 16 is a side view of another embodiment of a carrier for magnets constituting part of a membrane drive system.

A magnet carrier 20' which can be used instead of the magnet carrier 20 is shown in FIG. 16. The magnet carrier 20' has an upper surface 15 which faces the pumping chamber 8 and, contrary to the upper surface of the magnet carrier 20, the upper surface 15 of the magnet carrier 20' is rounded and at least approximately matched to the contour of the inner surface 5*a* of the pump head 5. The magnet carrier 20' allows the magnets 35 supported thereby, and hence the magnets 23 of the membrane 3, to be more closely spaced thus permitting the transmission of magnetic forces to be enhanced.

In FIGS. 10, 16 and 17, the membrane 3 is subjected to force by the magnet fields F. Not only are direct mechanical gripping of, and direct mechanical force introduction into, the membrane 3 avoided but the mechanical rotary motion necessary to generate the rotating magnet fields F can be obtained relatively simply by rotating the drive shaft 10.

A rotating magnet field can be generated without the rotary magnet carriers 20 and 20'. Thus, such a field can be produced electromagnetically in a manner known per se and will be effective to displace the membrane 3 as long as it is sufficiently close to the latter. With an electro-magnetically generated rotating magnetic field, mechanically rotating parts can be virtually eliminated from the membrane pump and it can be correspondingly compact.

Referring back to FIG. 1, the longitudinal axis of the drive pin 4 is indicated at 24, and the axis 24 intersects the central axis A of the membrane 3 in the vicinity of the inner surface 5*a* of the pump head 5. Consequently, the midpoint M of the membrane 3 undergoes relatively little displacement as the drive pin 4 is rotated by the drive shaft 10.

FIG. 8 shows that the longitudinal axis 24 of the drive pin 4 coincides with the central axis A of the membrane 3 when the membrane 3 is undeformed.

In FIG. 1, the clamping finger 13*a* projects radially from the peripheral wall 2*a* of the pump housing 2 for a distance of only about one-half the radius of the membrane 3 and only slightly, if at all, overlaps the radially protruding connecting head 4*a* of the drive pin 4. On the other hand, the clamping finger 13*a* in FIG. 8 extends to almost the central axis A of the membrane 3. The connecting head 4*a'* of the drive pin 4 of FIG. 8 protrudes farther radially than the connecting head 4*a* of the drive pin 4 of FIG. 1 and can provide greater stiffening of the central region 28 of the membrane 3.

Figure 2:
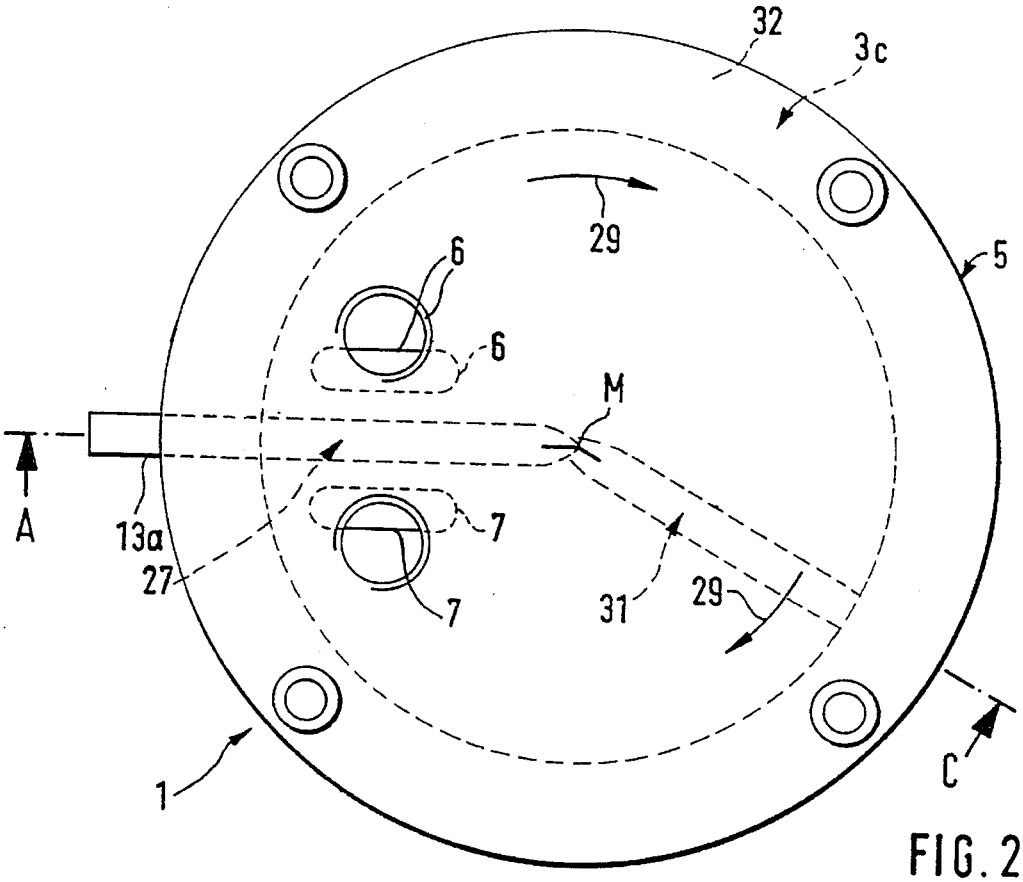
FIG. 2 is a plan view of another embodiment of a membrane pump according to the invention.
Figure 12:
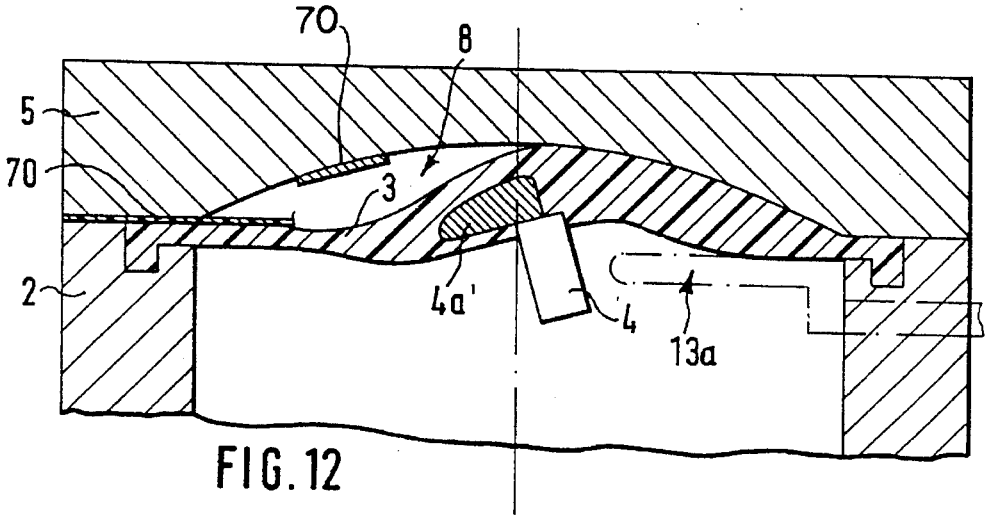
FIG. 12 is a fragmentary sectional view of still another embodiment of a membrane pump according to the invention showing a drive element for the membrane as seen in the direction of the arrows A—A of FIG. 13.
Figure 13:
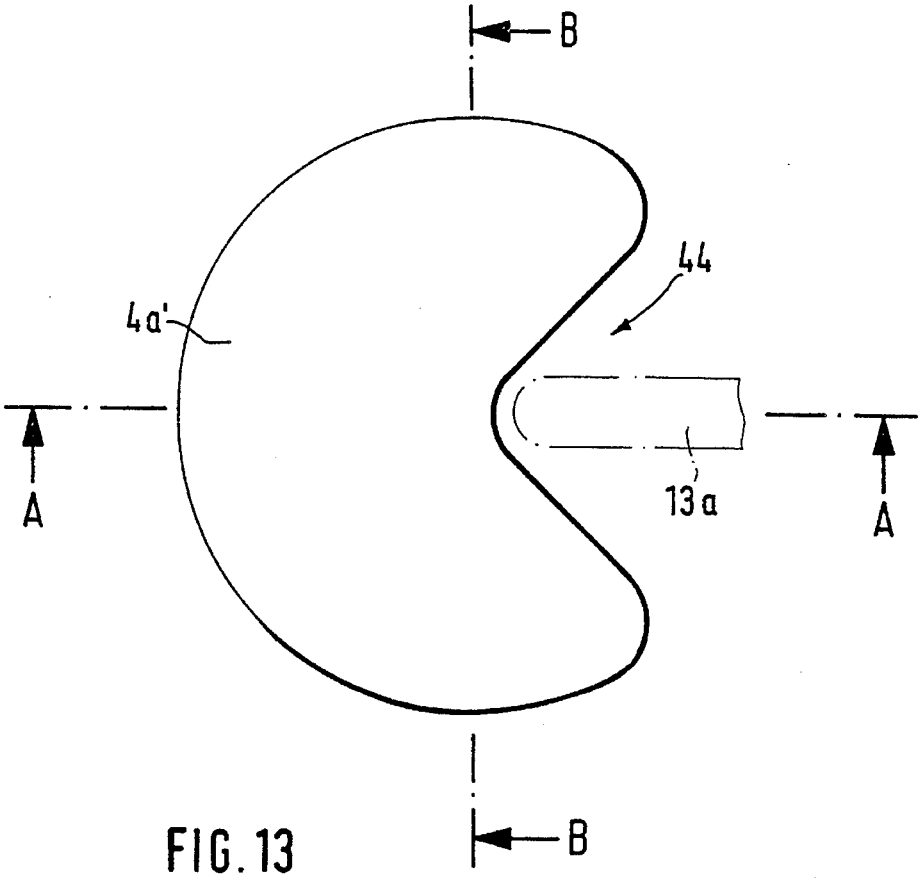
FIG. 13 is a greatly enlarged plan view of the head of the drive element of FIG. 12.
Figure 14:
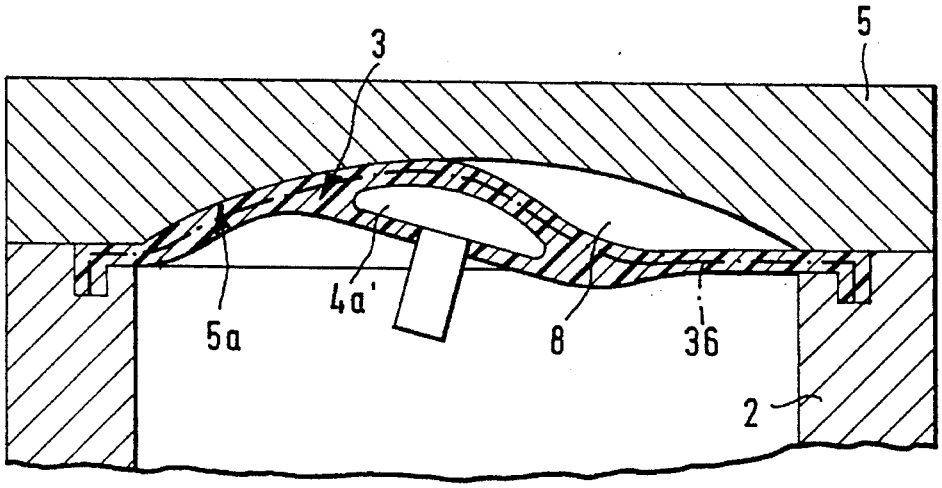
FIG. 14 is a fragmentary sectional view of an additional embodiment of a membrane pump in accordance with the invention, the pump including the drive element of FIG. 13 which is seen in the direction of the arrows B—B of FIG. 13.
Figure 15:
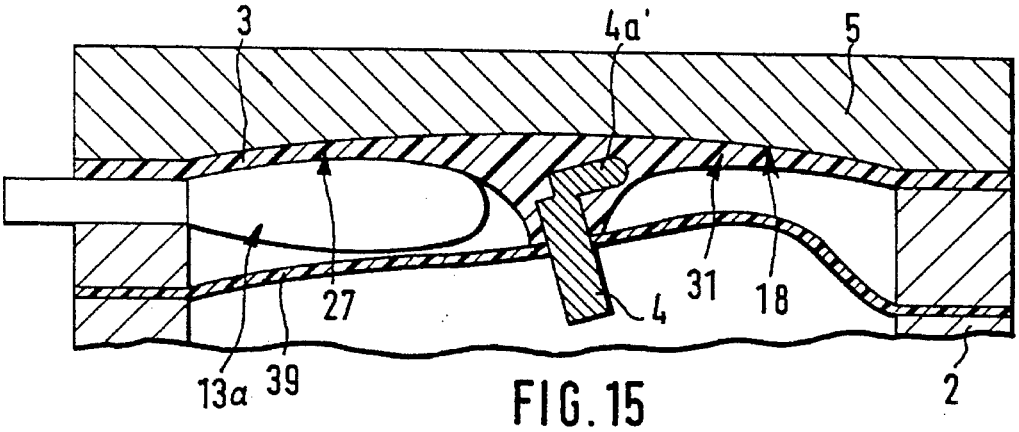
FIG. 15 is a sectional view as seen in the direction of the arrows A–C of FIG. 2.

FIGS. 12, 13, 14 and 15 also illustrate connecting heads 4*a'* which protrude farther radially than the connecting head 4*a* of FIG. 1 with FIGS. 12, 14 and 15 showing two different positions of the drive pin 4 during rotation. In order to prevent the relatively greatly radially protruding connecting heads 4*a'* from colliding with, and from compressing the membrane 3 excessively in the region of the clamping finger 13*a*, the connecting heads 4*a'* are designed asymmetrically. Thus, as shown in FIG. 13, the connecting heads 4*a'* are provided with an approximately V-shaped indentation 44 in the region of the clamping finger 13*a*. FIGS. 12 and 15, which represent two different positions of the drive pin 4 during rotation, illustrate that the connecting heads 4*a'* and clamping finger 13*a* do not interfere with each other as the drive pin 4 moves. FIG. 14, in which a segment of the membrane 3 is pressed against the inner surface 5*a* of the pump head 5, shows how a connecting head 4*a'* exerts pressure on the membrane 3.

with reference to FIGS. 2 and 15, the numeral 31 identifies a segment of the membrane 3 which is being urged into sealing engagement with the pump head 5 by the drive pin 4. In FIG. 2, the arrows 29 indicate the direction of rotation of the drive pin 4, and successive segments of the membrane 3, as considered in the direction 29, are successively and cyclically pressed into sealing engagement with the pump head 5 as the drive pin 4. Both the permanently confined, stationary segment 27 and the temporarily confined, displaceable segment 31 of the membrane 3 form seals with the pump head 5.

FIG. 15 further illustrates that a second membrane 39 may be provided in addition to the membrane 3 which constitutes the working membrane of the pump. The second membrane 39 is located somewhat below the membrane 3, that is, nearer the drive motor than the membrane 3, and is radially dimensioned such that it undergoes less elastic deformation than the membrane 3 during operation of the pump. The second membrane 39 serves as a safety membrane. Since it is subjected to less deformation than the working membrane 3, the second membrane 39 generally has a longer life than the membrane 3 and is still functional when the membrane 3 ruptures, for example. The second membrane 39 then prevents the pumped medium from flowing out of the pump or into the drive system.

Figure 18:
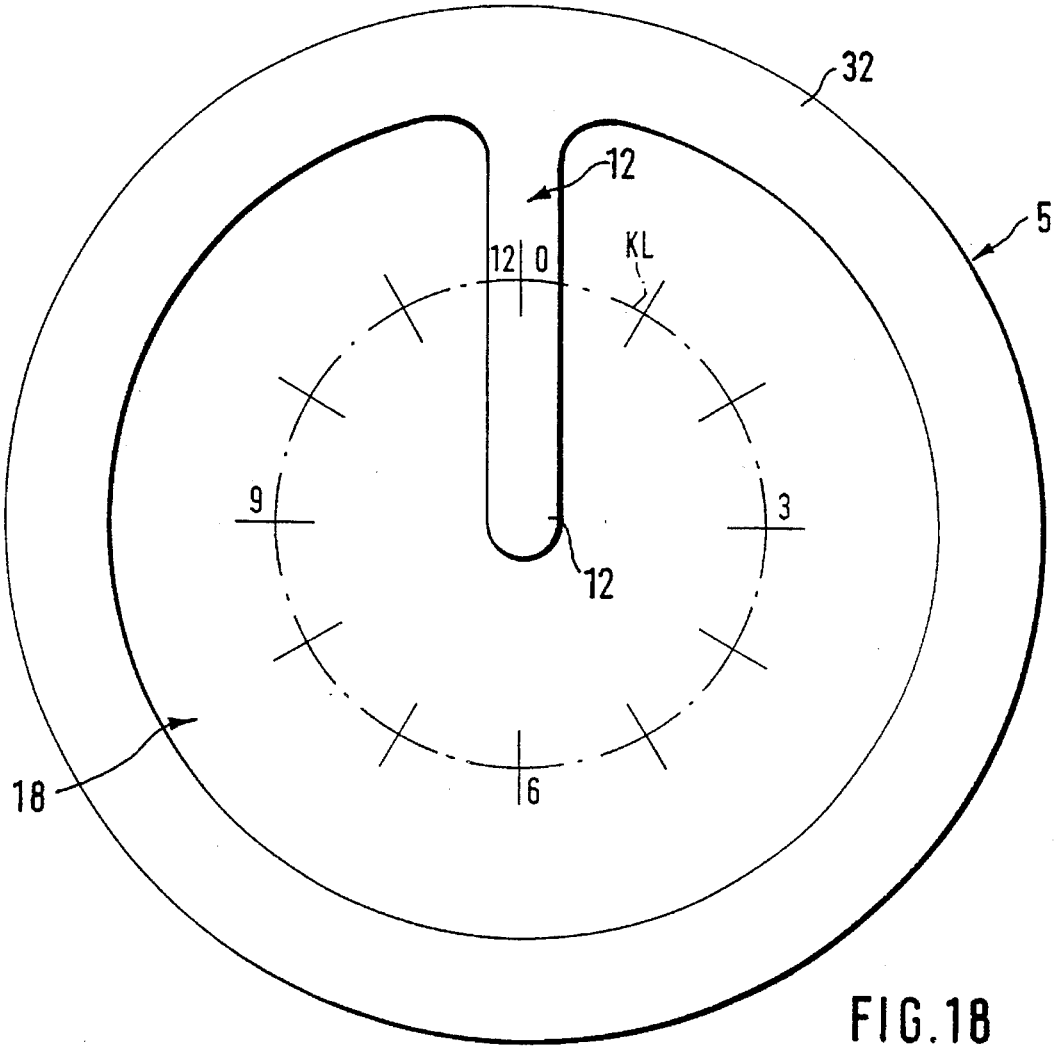
FIG. 18 is a schematic bottom view of the pump head of FIG. 3.
Figure 19:
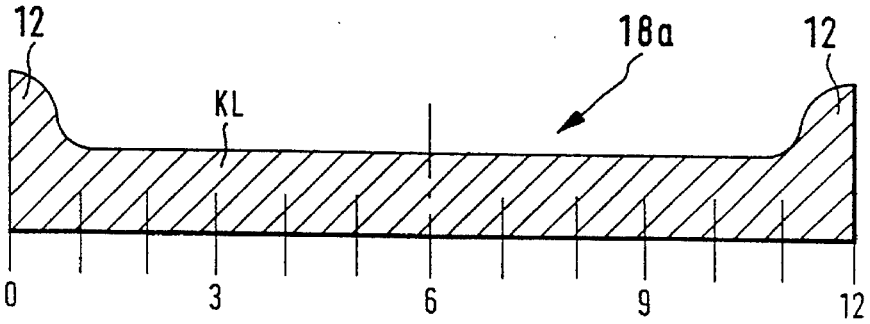
FIG. 19 is a developed sectional view along the contour line KL of FIG. 18.

FIG. 18 is a bottom view of the pump head 5 of FIG. 3 and KL in FIG. 18 denotes a contour line. FIG. 19 represents a developed sectional view along the contour line KL.

As seen in FIG. 19, there is a wave-like transition region between the separating rib 12 and the recess 18 on either side of the separating rib 12. Between the wave-like transition regions, the recess 18 has a flat central section 18*a* running along the contour line KL. A further transition region exists between the recess 18 and the rim 32 of the pump head 5 and can, for instance, be part-spherical.

In FIGS. 3, 18 and 19, the recess 18 has a generally circular outline. However, this need not be the case. Nor is it necessary for the central section of the recess 18 to be flat as at 18*a* or for the recess 18 to be provided with a separating rib 12.

Figure 20:
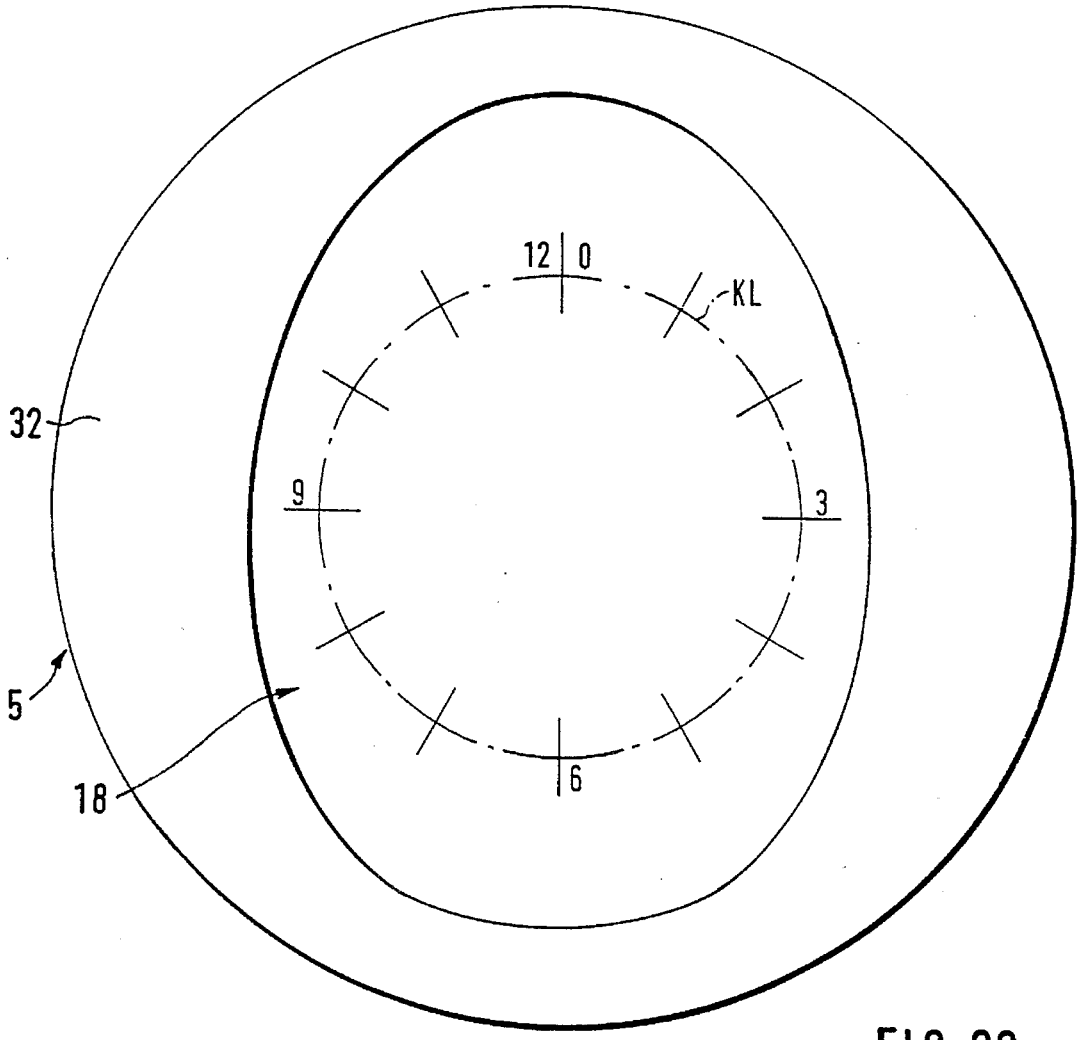
FIG. 20 is a bottom view of an additional embodiment of a pump head.
Figure 21:
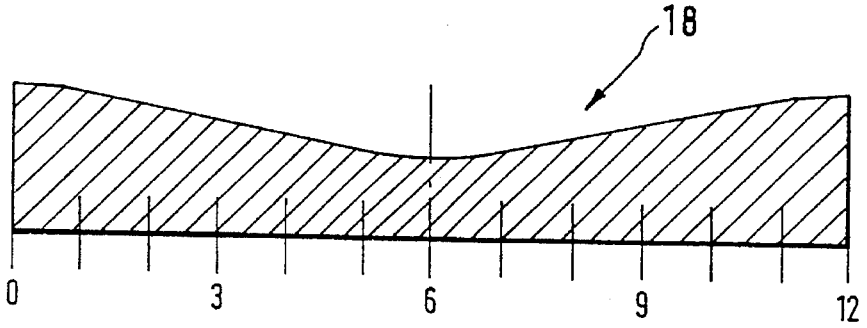
FIG. 21 is a developed sectional view along the contour line KL of FIG. 20.

By way of example, FIGS. 20 and 21 illustrate a recess 18 without a separating rib such as 12. The recess 18 of FIGS. 20 and 21 has an elliptical outline and, unlike the recess 18 of FIGS. 3, 18 and 19, does not have a flat central section.

A comparison of the recess 18 of FIGS. 3, 18 and 19 with the recess 18 of FIGS. 6 and 7 and that of FIGS. 20 and 21 shows that the shape of the recess 18 can be adjusted to provide the most favorable conditions for membrane displacement.

The connection between the membrane 3 and the support 16 need not be mechanical as in FIG. 11. Similarly, the seal between the pump head 5 and the sealing segment 27 of the membrane 3 does not have to be established mechanically by way of the clamping finger 13*a*. Thus, if permitted by the pumped medium and the other operating conditions, for example, the connection between the membrane 3 and the support 16, as well as the seal between the pump head 5 and the sealing segment 27, can be formed adhesively. However, mechanical means with complementary coupling portions as in FIG. 11 are preferred.

The surfaces of the membrane which come into contact with the pumped medium are normally chemically inert with respect to the medium. As illustrated in FIG. 12, the side 3*a* of the membrane 3 which contacts the pumped medium may be coated, in known manner, with a chemically inert layer 70. The layer 70 can, for instance, consist of polytetrafluoroethylene or PTFE. With chemically aggressive pumped media, the pump head 5 is not infrequently composed of stainless steel resistant to the pumped medium. As again indicated at 70 in FIG. 12, it is also possible to provide those surfaces of the pump head 5 which contact a chemically aggressive medium with a coating 70, e.g., of PTFE, resistant to the medium. If necessary, the entire pump head 5 may be composed of a chemically inert substance such as PTFE.

The membrane 3 may occasionally be subjected to substantial tensile loads. It is then of advantage to reinforce the membrane 3. For instance, the membrane 3 can be provided with a textile insert 36 as shown in FIG. 14.

Heat develops during operation of the membrane pump and, under certain circumstances, heat withdrawal means must be provided, particularly on the pump head 5. The heat withdrawal means can, for example, include a fluid cooling system. Due to the simple construction which can be achieved, it is preferred for the heat withdrawal means to encompass cooling ribs 37 on the pump head 5 as illustrated in FIG. 9

Experiments have demonstrated that the invention makes it possible to operate a membrane pump at relatively high rpm, e.g., 300 rpm. This corresponds to the rpm of a normal a.c. motor so that a step-down gear and similar additional measures can be avoided. Conventional peristaltic pumps, that is, pumps with hoses which are squeezed at a succession of locations along their lengths, are much more expensive to manufacture than a membrane pump according to the invention having a comparable capacity. Peristaltic pumps are also subject to high wear when the hoses are strongly squeezed. If strong squeezing of the hoses is avoided, one does not obtain a high vacuum, for example.

Various modifications can be made within the meaning and range of equivalence of the appended claims.

We claim:

1. A method of operating a pump having a pumping chamber bounded in part by a membranous wall having a central axis and a thickened central region, said method comprising the steps of:

admitting a flowable medium into said chamber at a first location;

discharging said medium from said chamber at a second location;

maintaining a seal between said locations and partway across said chamber by holding a first segment of said membranous wall substantially stationary and using said first segment as part of said seal; and directing said medium from said first location to said second location by successively displacing successive second segments of said membranous wall, as considered in a direction from said first location towards said second location, by successively deflecting successive Segments of Said thickened central region of said membranous wall along a circumferential path substantially centered about said central axis of said membranous wall.

2. The method of claim 1, wherein said direction is the circumferential direction of said chamber.

3. The method of claim 1, wherein said chamber has a periphery and a center, said seal extending from said periphery at least to the region of said center.

4. A pump, comprising:

a housing including a membranous first wall having a central axis and a thickened central region, and a second wall disposed opposite said membranous first wall and provided with an inlet and an outlet, said first and second walls being in contact at said thickened central region of said first wall and defining a pumping chamber circumferentially around said thickened central region;

means for maintaining a first segment of said membranous first wall adjacent said second wall between said inlet and said outlet so as to establish a seal which extends between said inlet and said outlet partway across said chamber; and a driving element positioned within said thickened central region of said membranous wall and having a longitudinal axis at an angle to said central axis and intersecting said central axis substantially at said second wall, said driving element successively urging successive second segments of said thickened central region of said membranous first wall, as considered in a direction from said inlet towards said outlet, towards said second wall to thereby direct a flowable medium from said inlet to said outlet.

5. The pump of claim 4, wherein said membranous first wall has a marginal portion in sealing engagement with said housing.

6. The pump of claim 4, wherein said chamber has a periphery and a center, said seal extending from said periphery at least to the region of said center.

7. The pump of claim 4, wherein said direction is the circumferential direction of said chamber.

8. The pump of claim 4, wherein said chamber has a central axis and is substantially rotationally symmetrical about said central axis.

9. The pump of claim 4, wherein said first segment is provided with a sealing ridge, said sealing ridge and said second wall having respective surface portions which are arranged to confront, and are complementary to, one another.

10. The pump of claim 4, wherein said first segment is provided with a raised bead.

11. The pump of claim 4, wherein said second wall comprises stainless steel.

12. The pump of claim 4, wherein said membranous first wall has a side which faces said chamber and is coated with a chemically inert substance.

13. The pump of claim 12, wherein said substance comprises PTFE.

14. The pump of claim 4, wherein said second wall has a side which faces said chamber and is coated with a chemically insert substance.

15. The pump of claim 14, wherein said substance comprises PTFE.

16. The pump of claim 4, wherein said second wall is composed of a chemically inert substance.

17. The pump of claim 16, wherein said substance comprises PTFE.

18. The pump of claim 4, wherein said membranous first wall comprises a reinforcement.

19. The pump of claim 18, wherein said reinforcement comprises a textile.

20. The pump of claim 4, further comprising heat removing means in the region of said second wall.

21. The pump of claim 20, wherein said heat removing means comprises a cooling rib.

22. The pump of claim 4, further comprising a membranous safety wall for preventing the escape of the flowable medium in the event of rupture of said membranous first wall.

23. The pump of claim 22, wherein said membranous safety wall is designed to undergo less deformation than said membranous first wall during conveyance of the flowable medium from said inlet to said outlet.

24. The pump of claim 4, further comprising a support for said membranous first wall.

25. The pump of claim 24, wherein said support and said membranous first wall are coupled to one another.

26. The pump of claim 25, wherein one of said support and said membranous first wall is provided with an opening and the other of said support and said membranous first wall is provided with a peg receivable in said opening, said opening having an internal shoulder and said peg having a radially protruding portion arranged to be arrested by said shoulder.

27. The pump of claim 24, wherein said support is at least approximately basin-shaped and has a supporting rim which engages, and is substantially parallel to, said membranous first wall.

28. The pump of claim 27, wherein said support is provided with a cutout in the region of said first segment, said maintaining means including a clamping element which extends into said cutout.

29. The pump of claim 28, wherein said clamping element is received in said cutout with a clearance sufficient to permit said support to remain clear of said clamping element during movement of said support with said membranous first wall.

30. The pump of claim 4, wherein said maintaining means comprises a clamping element for holding said first segment against said second wall.

31. The pump of claim 30, further comprising means for adjusting the clamping force exerted by said clamping element.

32. The pump of claim 30, wherein said clamping element is elongated and is eccentrically mounted on said housing.

33. The pump of claim 32, wherein said clamping element extends substantially radically of said central axis.

34. The pump of claim 32, further comprising means for adjusting the clamping force exerted by said clamping element from externally of said housing.

35. The pump of claim 4, wherein said driving element comprises a rod-like element which is connected to said thickened central region of said membranous first wall at a first end, said rod-like element having a second end which is laterally spaced from said central axis; said driving element further comprising a drive shaft for moving said second end along a closed path having a center which lies at least in the region of said central axis.

36. The pump of claim 35, further comprising a support for said membranous first wall, said support being connected to said rod-like element.

37. The pump of claim 35, wherein said thickened central region of said membranous wall is in the form of a protuberance extending in a direction away from said second wall and said rod-like element is mounted on said protuberance.

38. The pump of claim 37, wherein said rod-like element has a radially protruding first coupling portion and said thickened central region is provided with a second coupling portion which is substantially complementary to and engages said first coupling portion.

39. The pump of claim 37, wherein said rod-like element is vulcanized to said protuberance.

40. The pump of claim 37, wherein said substantially at said second wall is the longitudinal axis of said rod-like element, said rod-like element being coupled to said drive shaft through a bearing, said bearing being a roller bearing and said rod-like element being rotatably mounted in said roller bearing.

41. The pump of claim 4, wherein said second wall is provided with a recess which confronts said membranous first wall and constitutes part of said chamber.

42. The pump of claim 41, wherein said housing comprises a cover which includes said second wall.

43. The pump of claim 41, wherein said recess has a shape at least approximating that of a spherical dome.

44. The pump of claim 41, wherein said second wall is provided with a rib in said recess, said rib being disposed between said inlet and said outlet and constituting an abutment for said first segment.

45. The pump of claim 44, wherein said rib is located approximately midway between said inlet and said outlet.

46. The pump of claim 44, wherein said chamber has a periphery and a center, said rib extending from said periphery at least to the region of said center.

47. The pump of claim 44, wherein said housing comprises a cover which is in the form of a substantially flat disc and includes said second wall.

* * * * *